US005437258A

United States Patent [19]

Williams et al.

[11] Patent Number: 5,437,258

[45] Date of Patent: Aug. 1, 1995

[54] CARBURETOR FUEL ATOMIZER

[76] Inventors: Edward F. Williams; Sylvia M. Williams, both of 416 Bridgewiew Ct. #101, Virginia Beach, Va. 23452

[21] Appl. No.: 285,164

[22] Filed: Aug. 3, 1994

[51] Int. Cl.[6] ..... F02M 29/04

[52] U.S. Cl. ..... 123/593; 48/189.6

[58] Field of Search ..... 123/593; 48/189.6

[56] References Cited

U.S. PATENT DOCUMENTS

| | | | |
|---|---|---|---|
| 2,899,949 | 8/1959 | Hicks | 123/593 |
| 4,020,812 | 5/1977 | Hayward | 123/593 |
| 4,106,454 | 8/1978 | Henlis | 123/593 |
| 4,108,125 | 8/1978 | Marcoux et al. | 123/549 |
| 4,491,118 | 1/1985 | Wooldridge | 123/593 |
| 4,667,648 | 5/1987 | Beldin | 123/593 |

FOREIGN PATENT DOCUMENTS

| | | | |
|---|---|---|---|
| 0580700 | 9/1946 | United Kingdom | 123/593 |
| 8801687 | 3/1988 | WIPO | 123/593 |

*Primary Examiner*—Henry C. Yuen

*Assistant Examiner*—Erick Solis

[57] ABSTRACT

A carburetor fuel atomizer comprising a carburetor having an input end and an output end for feeding gasoline to an internal combustion engine; a manifold having an input end and an output end, the input end of the manifold being in fluid communication with the output end of the carburetor, the manifold adapted to distribute fuel from the carburetor to the appropriate portion of an internal combustion engine; means to releasably couple the carburetor to the manifold with the output ends of the carburetor in fluid communication with the input end of the manifold; and an atomizer for dispersing the fuel leaving the carburetor prior to entering the manifold, the atomizer including a first gasket with an aperture therethrough coupled to the carburetor, a second gasket coupled to the input of the manifold, a screen fabricated of stainless steel positioned between the gaskets whereby fluid from the carburetor moving toward the manifold will be atomized prior to being fed to an internal combustion engine to increase performance and efficiency of the internal combustion engine.

2 Claims, 5 Drawing Sheets

FIG 4
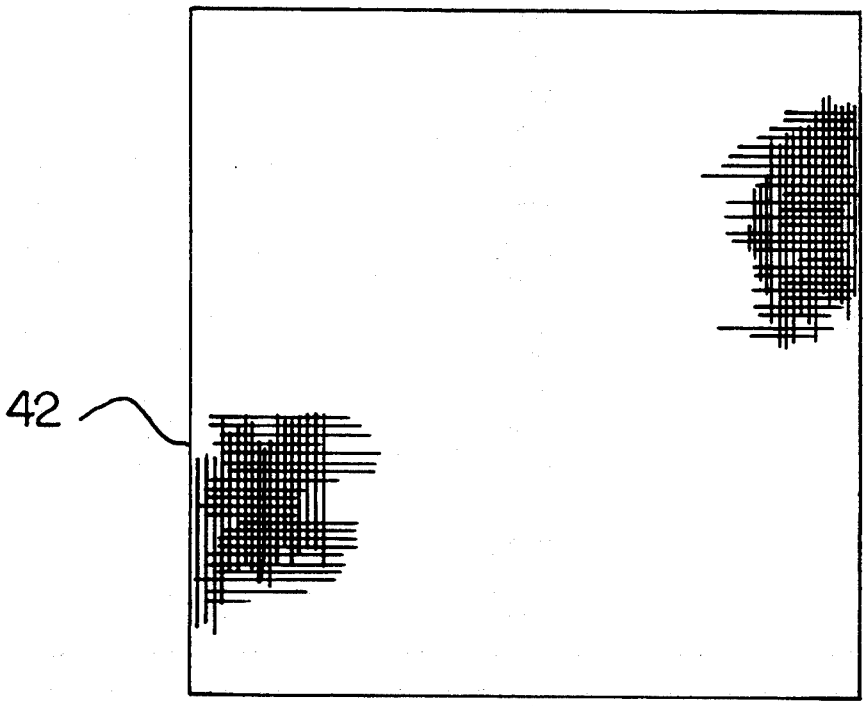
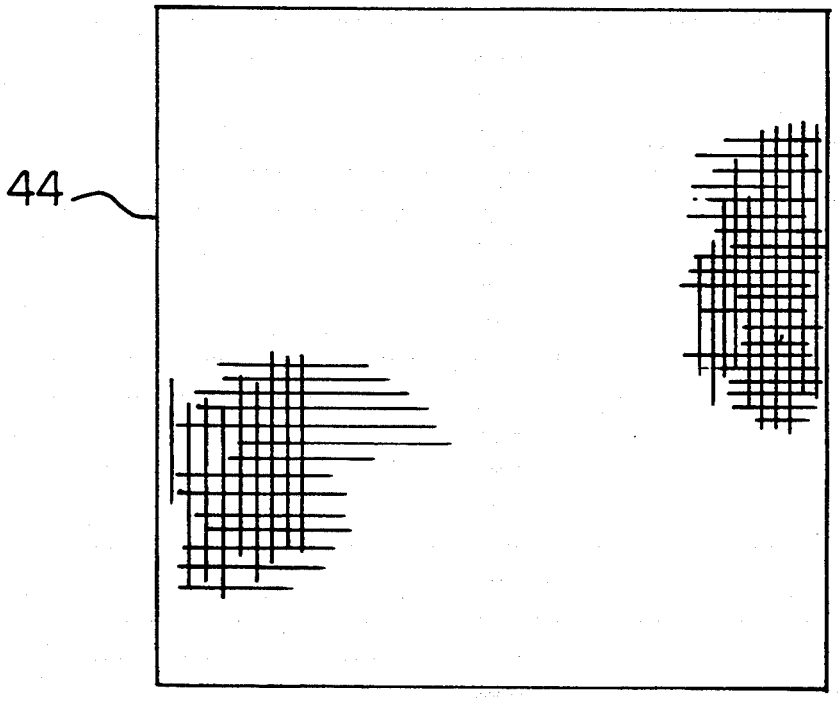
FIG 5

FIG 6
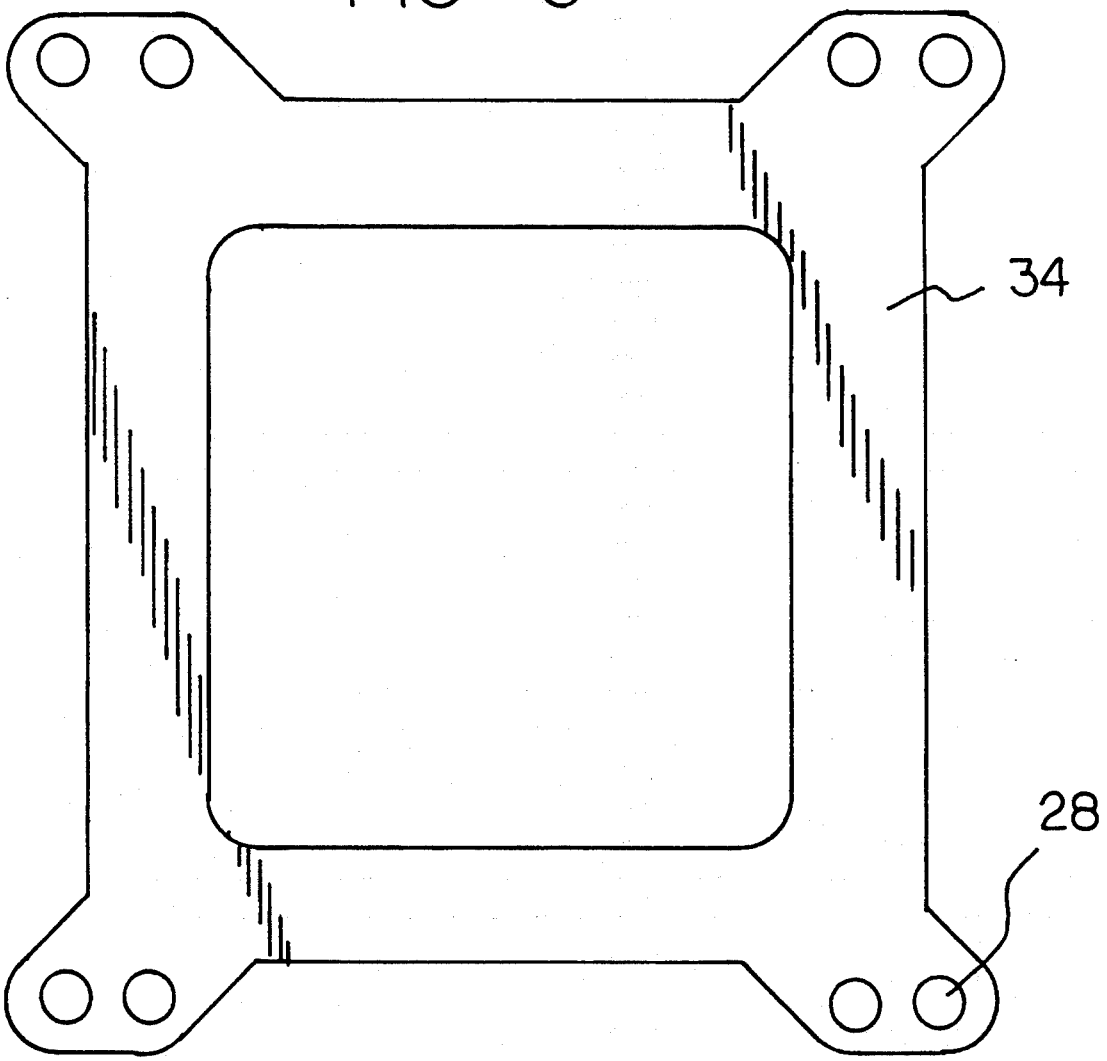
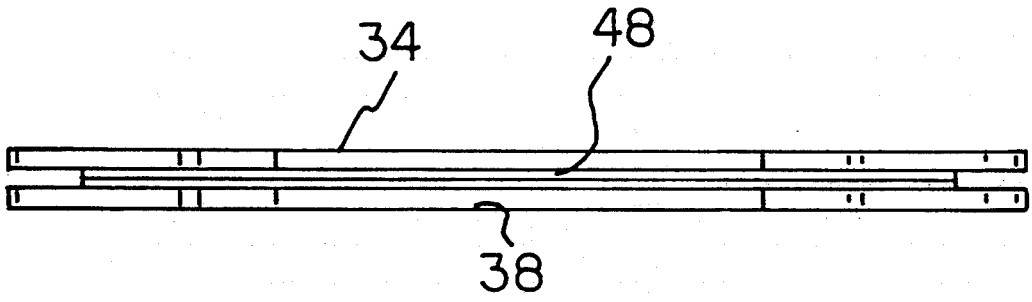
FIG 7

CARBURETOR FUEL ATOMIZER

BACKGROUND OF THE INVENTION

1. Field of the Invention

The present invention relates to a carburetor fuel atomizer and more particularly pertains to atomizing fuel between the carburetor and manifold so as to improve automotive performance.

2. Description of the Prior Art

The use of various devices and techniques for improving gas mileage rate and operating performance of vehicles is known in the prior art. More specifically, various devices and techniques for improving gas mileage rate and operating performance of vehicles heretofore devised and utilized are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,968,781 a fuel atomizing device for carburetors of internal combustion engines.

U.S. Pat. No. 4,063,541 discloses a carburetor providing a uniformly atomized fuel-air mixture.

U.S. Pat. No. 4,162,281 discloses a carburetor fuel atomization apparatus.

U.S. Pat. No. 5,000,152 discloses a fuel conservation means for internal combustion engines.

U.S. Pat. No. 5,053,170 discloses a fuel atomizing device for carburetors.

In this respect, the carburetor fuel atomizer according to the present invention substantially departs from the conventional concepts and designs of the prior art, and in doing so provides an apparatus primarily developed for the purpose of atomizing fuel between the carburetor and manifold so as to improve automotive performance.

Therefore, it can be appreciated that there exists a continuing need for a new and improved carburetor fuel atomizer which can be used to atomize fuel between the carburetor and manifold so as to improve automotive performance. In this regard, the present invention substantially fulfills this need.

SUMMARY OF THE INVENTION

In view of the foregoing disadvantages inherent in the known types of various devices and techniques for improving gas mileage rate and operating performance of vehicles now present in the prior art, the present invention provides an improved carburetor fuel atomizer. As such, the general purpose of the present invention, which will be described subsequently in greater detail, is to provide a new and improved carburetor fuel atomizer and method which has all the advantages of the prior art and none of the disadvantages.

To attain this, the present invention essentially comprises a new and improved carburetor fuel atomizer comprising, in combination, a carburetor having an input end and an output end for feeding gasoline to an internal combustion engine; a manifold having an input end and an output end, the input end of the manifold being in fluid communication with the output end of the carburetor, the manifold adapted to distribute fuel from the carburetor to the appropriate portion of an internal combustion engine; means to releasably couple the carburetor to the manifold with the output end of the carburetor in fluid communication with the input end of the manifold; andan atomizer for dispersing the fuel leaving the carburetor prior to entering the manifold, the atomizer including a first gasket with an aperture therethrough coupled to the output end of the carburetor, a second gasket coupled to the input end of the manifold, a first screen fabricated of nylon mesh with about 160 to 280 mesh count coupled to the first gasket and a second screen of stainless steel with about a 20 mesh count positioned between the second gasket and the first screen whereby fluid from the carburetor moving toward the manifold will be atomized prior to being fed to an internal combustion engine to increase performance and efficiency of the internal combustion engine.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved carburetor fuel atomizer which has all the advantages of the prior art various devices and techniques for improving gas mileage rate and operating performance of vehicles and none of the disadvantages.

It is another object of the present invention to provide a new and improved carburetor fuel atomizer which may be easily and efficiently manufactured and marketed.

It is further object of the present invention to provide a new and improved carburetor fuel atomizer which is of durable and reliable constructions.

An even further object of the present invention is to provide a new and improved carburetor fuel atomizer which is susceptible of a low cost of manufacture with regard to both materials and labor, and which accordingly is then susceptible of low prices of sale to the consuming public, thereby making such carburetor fuel atomizers economically available to the buying public.

Still yet another object of the present invention is to provide a new and improved carburetor fuel atomizer which provides in the apparatuses and methods of the prior art some of the advantages thereof, while simultaneously overcoming some of the disadvantages normally associated therewith.

Still another object of the present invention is to atomize fuel between the carburetor and manifold so as to improve automotive performance.

Lastly, it is an object of the present invention to provide new and improved carburetor fuel atomizer comprising a carburetor having an input end and an output end for feeding gasoline to an internal combustion engine; a manifold having an input end and an output end, the input end of the manifold being in fluid communication with the output end of the carburetor, the manifold adapted to distribute fuel from the carburetor to the appropriate portion of an internal combustion engine; means to releasably couple the carburetor to the manifold with the output ends of the carburetor in fluid communication with the input end of the manifold; and an atomizer for dispersing the fuel leaving the carburetor prior to entering the manifold, the atomizer including a first gasket with an aperture therethrough coupled to the carburetor, a second gasket coupled to the input of the manifold, a screen fabricated of stainless steel positioned between the gaskets whereby fluid from the carburetor moving toward the manifold will be atomized prior to being fed to an internal combustion engine to increase performance and efficiency of the internal combustion engine.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a plan view of the first atomizing screen as shown in FIG. 3.

FIG. 5 is a front elevational view of the second atomizing screen as shown in FIG. 3.

FIG. 6 is a plan view of one of the gaskets.

FIG. 7 is an end elevational view of the assembled atomizer of the prior Figure.

The same reference numerals refer to the same parts through the various Figures.

DESCRIPTION OF THE PREFERRED EMBODIMENT

Figure 1:
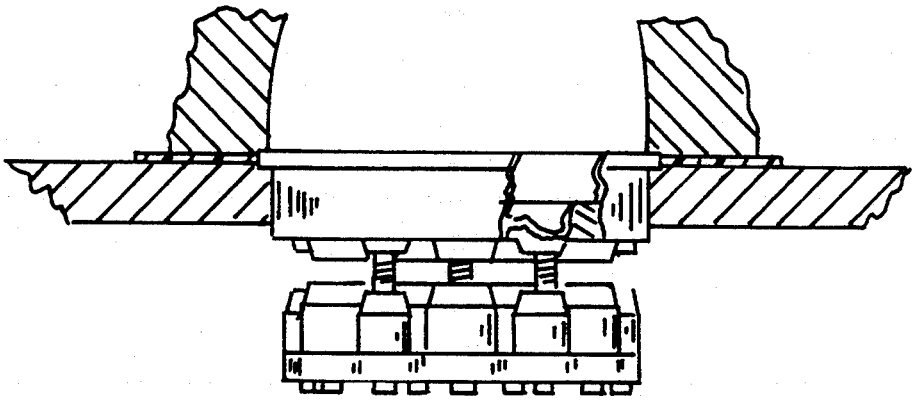
FIG 1 PRIOR ART
FIG. 1 is a cross-sectional view of a carburetor/-manifold interface constructed in accordance with the prior art.
Figure 2:
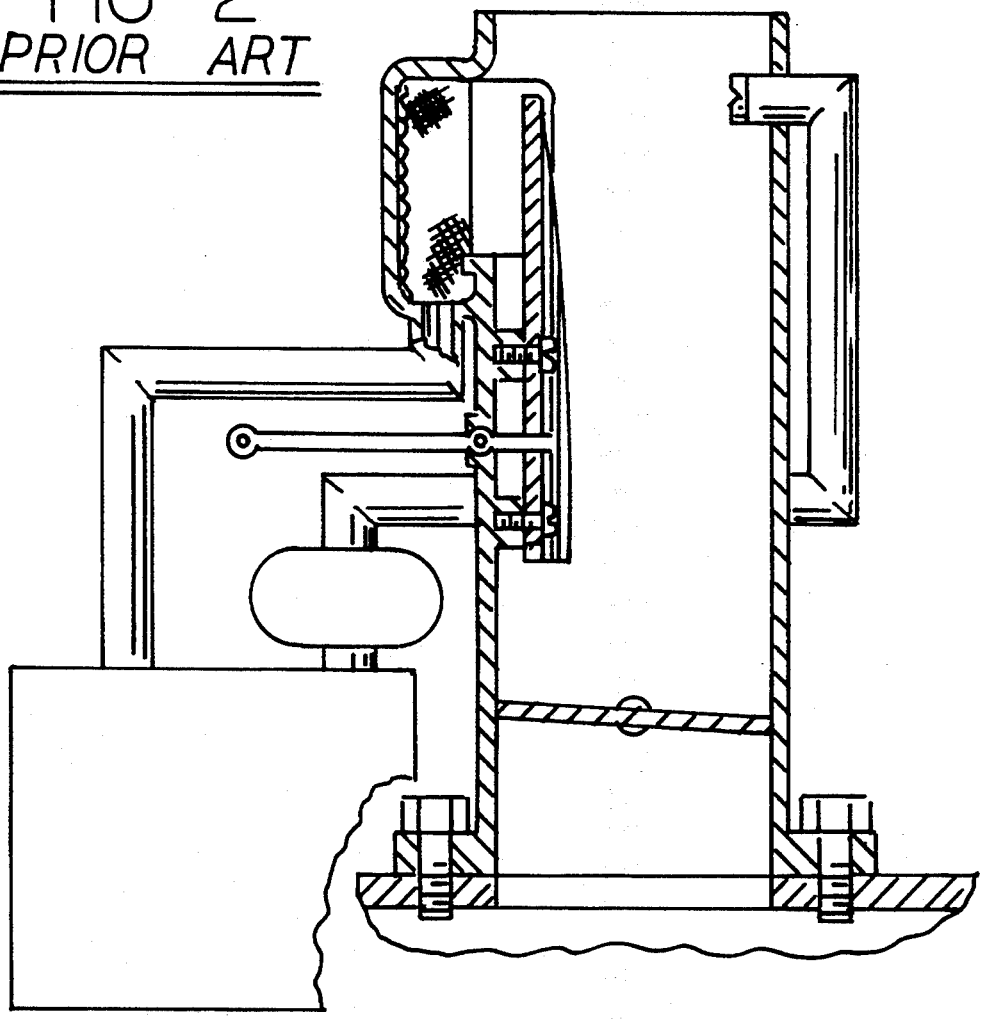
FIG 2 PRIOR ART
FIG. 2 is a cross-sectional view of another prior art device for modifying the carburetor for improved performance of an internal combustion engine.

With reference now to the drawings, and in particular to FIG. 1 thereof, the preferred embodiment of the new and improved carburetor fuel atomizer embodying the principles and concepts of the present invention and generally designated by the reference numeral 10 will be described.

The present invention, the new and improved carburetor fuel atomizer is a system comprised of a plurality of components. Such components, in their broadest context, include a carburetor, a manifold, means coupling the carburetor and manifold, and an atomizer. Each of the individual components is specifically configured and correlated one with respect to each other so as to attain the desired objective.

Figure 3:
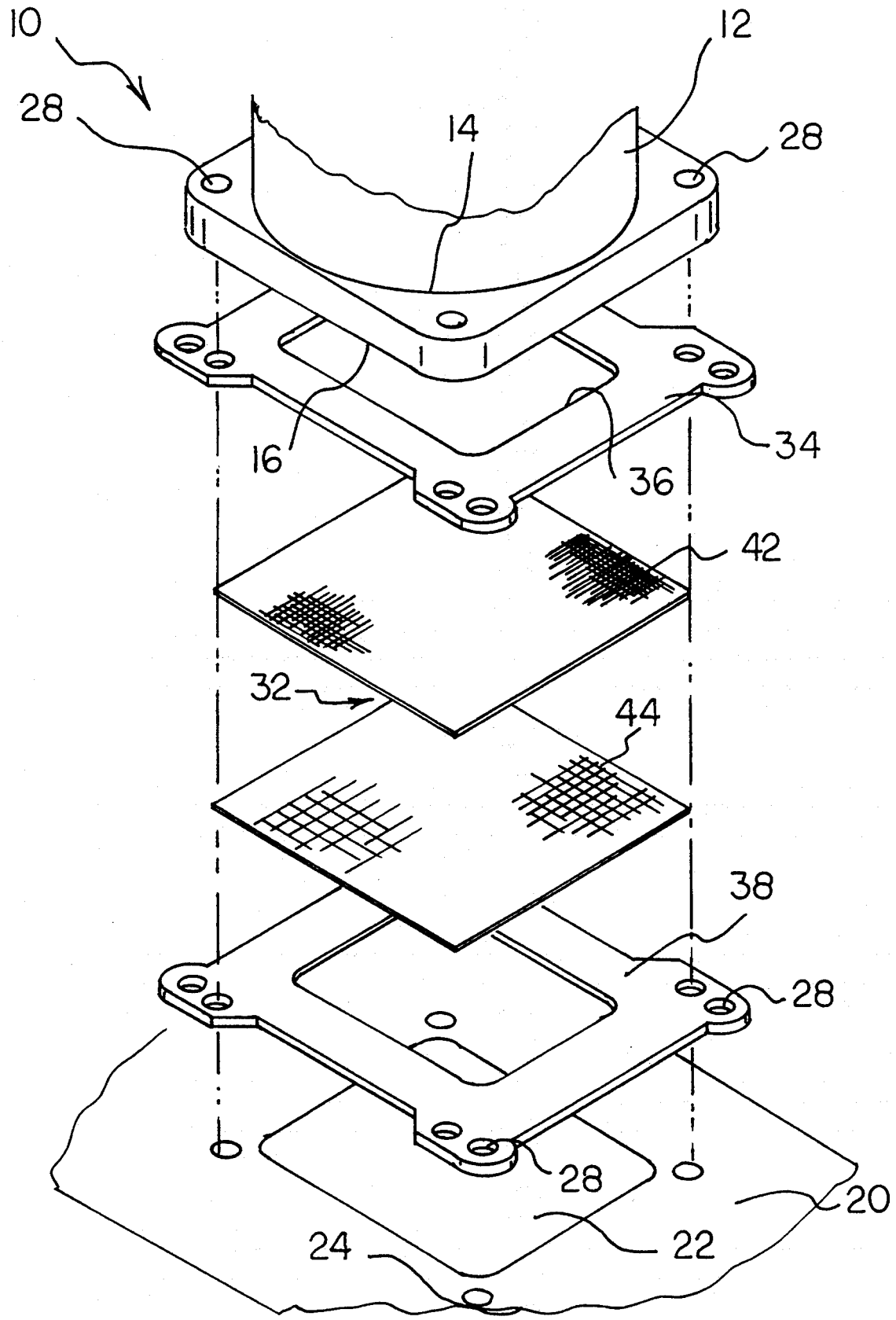
FIG. 3 is an exploded perspective view of the preferred embodiment of the carburetor fuel atomizer constructed in accordance with the principles of the present invention.

As shown particularly in FIG. 3, a central component of the system 10 of the present invention is a carburetor 12. The carburetor has an input end 14 and an output end 16. Carburetors function by feeding gasoline to an internal combustion engine, not shown. Such engine may be put in any type of car, truck or other motorized vehicle.

Next provided is a manifold 20. The manifold has an input end 22 and an output end 24. The input end of the manifold is in fluid communication with the output end of the carburetor. The manifold is adapted to distribute fuel fed from the carburetor to the appropriate portion or portions of the internal combustion engine of the vehicle.

In association with the carburetor and manifold, apertures 28 are provided adjacent to the periphery. Such apertures function in association with threaded bolts to couple the carburetor to the manifold with the output end of the carburetor in fluid communication with the input end of the manifold.

Lastly provided is an atomizer 32. The atomizer functions for dispersing fuel leaving the carburetor prior to entering the manifold. The atomizer includes a first gasket 34 with a central aperture 36 therethrough. The first gasket is coupled to the carburetor. Also provided is a second gasket 38. Such second gasket is coupled to the input end of the manifold.

Located between the first and second manifold in the embodiment of FIGS. 3–7, a first screen 42 is provided. Such first screen is fabricated of a nylon mesh with about 160 to 180 mesh count. Such first screen is coupled to the first gasket. The next component is a second screen 44. The second screen is fabricated of a stainless steel material. It has about a 20 mesh count, plus or minus ten percent in size, positioned between the second gasket and the first gasket. In this manner, fuel from the carburetor moving toward the manifold will be atomized prior to being fed to an internal combustion engine. In this manner, the performance and efficiency of the internal combustion engine is increased when such screens and gaskets are utilized.

Figure 8:
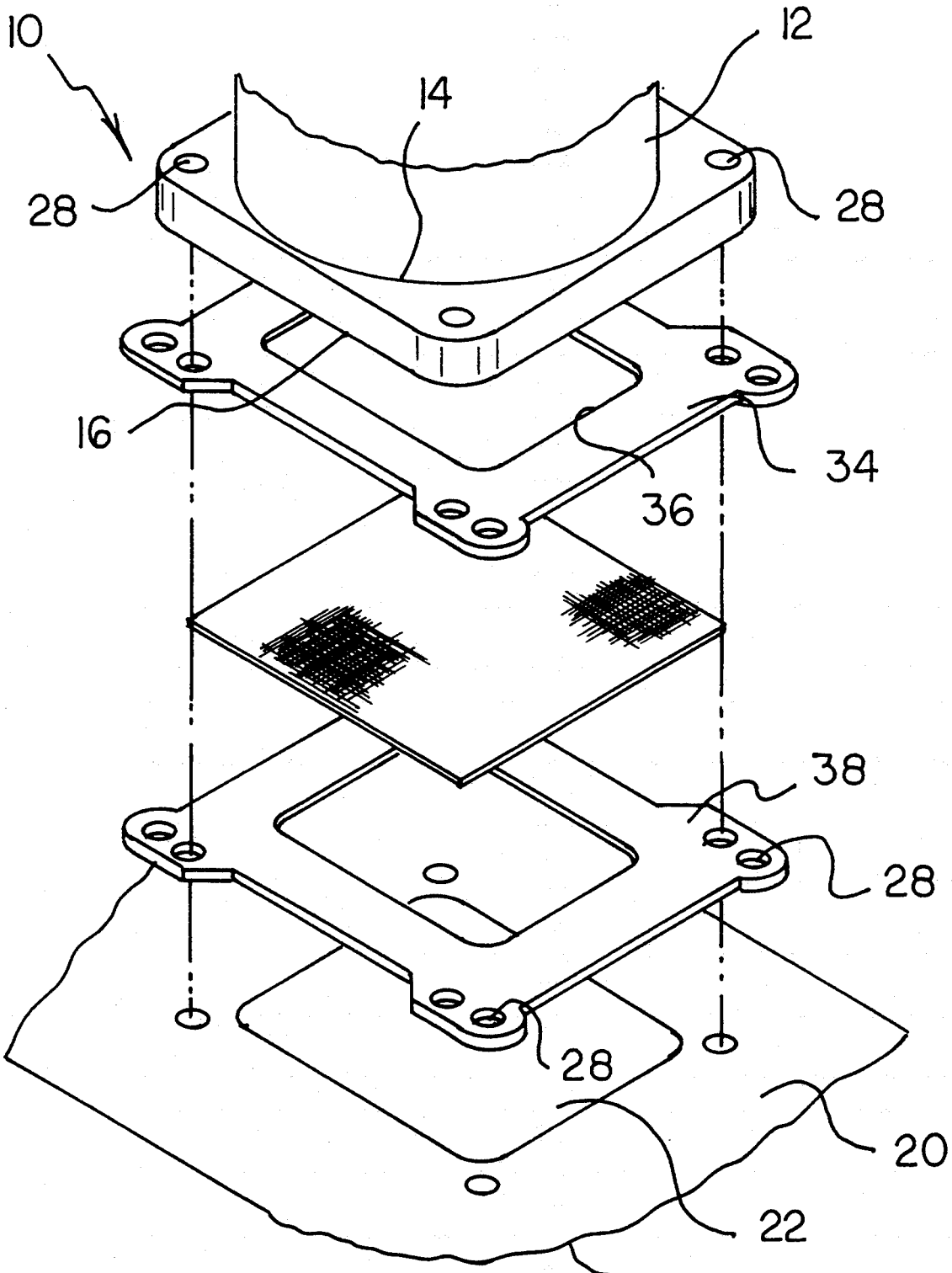
FIG. 8 is an exploded perspective illustration similar to FIG. 3 but illustrating an alternate embodiment of the invention.

An alternate embodiment of the invention is shown in FIG. 8. According to such alternate embodiment, the nylon and stainless steel screen as described above are eliminated. In place thereof, a single screen is employed. Such single screen is fabricated of stainless steel. Such screen is about 0.0016 inches in thickness, plus or minus ten percent. It has a mesh count of about 270×270, plus or minus ten percent. Such single screen is sufficient for the necessary rigidity as well as fineness of screen size to effect the desired results.

By count it is meant the number of strands in an inch. Consequently, a 270 by 270 count screen has 270 strands per inch in each direction. Strands with a thickness of 0.0016 inches in a screen of 270 by 270 count would occupy about 0.4320 inches leaving about 270 openings with each equal to 0.5680 inches or slightly greater than 0.0016 inches between individual strands.

This device installs between the carburetor and intake manifold of an internal combustion engine. It was designed to increase torque and horsepower with possibly some fuel consumption improvement. The components include, for 4 bbl carburetor, approximately 20 square inches of number 160 to 288 count nylon mesh screen and 20 square inches of number 20 count stainless steel screen in combination with two stock gaskets, or make your own, and a negligible amount of RTV or similar substitute. Two vehicles were used for testing, a 1975 Corvette with a slightly modified 350 c.i. and a 1978 Ford 150 Crew Cab with a stock 302 c.i. Prior to installing the modified gasket the Corvette accelerated 0 to 60 m.p.h. in 8.5 sec. After the modification, 0 to 60 m.p.h. was achieved in slightly less than 7.0 seconds. Because of the truck mass weight, testing was intended to show how much pulling power could be realized with the same modification configuration. It surpassed all expectations. Several mesh count screens were tried, but the 160 plus mesh count atomized the fuel closer to competition with fuel injected engines. The 20 mesh count steel screen contributes no part in the fuel atomization but only to support the fine screen and also aid to dissipate heat. One additional component required utilizing this modification is a spacer ⅜ inch or ½ inch thick to permit clearance for carburetor throttle valves.

In an alternate embodiment of the invention, the use of two screens, nylon and stainless steel, is eliminated in favor of a single-lined stainless steel screen of about only 0.016 inches thick. Such screen will compress airtight into the gasket material. Stainless has a long life under severe corrosion and temperature conditions. Cost is reduced. Such screen is one piece of 270×270 count stainless steel screen, 0.0016 inches thick sandwiched between two stock or manufactured carburetor gaskets. Such has shown to provide very favorable results which can be realized utilizing the screen as described above plus or minus about ten percent in size.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved carburetor fuel atomizer comprising, in combination:

a carburetor having an input end and an output end for feeding gasoline to an internal combustion engine;

a manifold having an input end and an output end, the input end of the manifold being in fluid communication with the output end of the carburetor, the manifold adapted to distribute fuel from the carburetor to the appropriate portion of an internal combustion engine;

means to releasably couple the carburetor to the manifold with the output end of the carburetor in fluid communication with the input end of the manifold; and an atomizer for dispersing the fuel leaving the carburetor prior to entering the manifold, the atomizer including a first gasket with an aperture therethrough coupled to the output end of the carburetor, a second gasket coupled to the input end of the manifold, a first screen fabricated of nylon mesh with about 160 to 280 mesh count coupled to the first gasket and a second screen of stainless steel with about a 20 mesh count positioned between the second gasket and the first screen whereby fluid from the carburetor moving toward the manifold will be atomized prior to being fed to an internal combustion engine to increase performance and efficiency of the internal combustion engine.

2. A carburetor fuel atomizer comprising:

a carburetor having an input end and an output end for feeding gasoline to an internal combustion engine;

a manifold having an input end and an output end, the input end of the manifold being in fluid communication with the output end of the carburetor, the manifold adapted to distribute fuel from the carburetor to the appropriate portion of an internal combustion engine;

means to releasably couple-the carburetor to the manifold with the output ends of the carburetor in fluid communication with the input end of the manifold;

an atomizer for dispersing the fuel leaving the carburetor prior to entering the manifold, the atomizer including a first gasket with an aperture therethrough coupled to the carburetor, a second gasket coupled to the input of the manifold, a screen fabricated of stainless steel positioned between the gaskets whereby fluid from the carburetor moving toward the manifold will be atomized prior to being fed to an internal combustion engine to increase performance and efficiency of the internal combustion engine; and the screen being about 0.0016 inches thick, plus or minus ten percent, with about a 270 by 270 mesh count, plus or minus ten percent.

* * * * *